US008635000B1

(12) United States Patent
Hendrickson et al.

(10) Patent No.: US 8,635,000 B1
(45) Date of Patent: Jan. 21, 2014

(54) BRAKE MONITORING SYSTEM

(71) Applicant: Caterpillar Inc., Peoria, IL (US)

(72) Inventors: Matthew L. Hendrickson, Dunlap, IL (US); Alexander C. Crosman, III, Dunlap, IL (US); Bo Xie, Peoria, IL (US); Bradley S. Bailey, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/676,261

(22) Filed: Nov. 14, 2012

(51) Int. Cl.
*G06F 19/00* (2011.01)

(52) U.S. Cl.
USPC ..... 701/70; 701/22; 701/54; 701/84; 701/102; 318/139; 318/375; 318/432; 180/65.265

(58) Field of Classification Search
USPC ..... 318/139, 375, 432; 180/65.265; 482/6, 482/903; 242/433.3; 29/596; 60/449; 74/733.1; 477/107; 322/28; 701/22, 54, 701/70, 84, 102
See application file for complete search history.

(56) References Cited

U.S. PATENT DOCUMENTS 4,865,146 A * 9/1989 Ohe ..... 180/413
4,886,291 A * 12/1989 Okamoto ..... 280/5.501
5,194,851 A * 3/1993 Kraning et al. ..... 340/438
5,283,740 A * 2/1994 Sato et al. ..... 701/43
5,839,530 A * 11/1998 Dietzel ..... 180/65.245
6,691,009 B1 * 2/2004 Yao et al. ..... 701/41
6,694,239 B1 * 2/2004 Yao et al. ..... 701/41
6,736,604 B2 * 5/2004 Okada et al. ..... 417/213
7,034,476 B2 * 4/2006 Wang et al. ..... 318/139
7,075,458 B2 * 7/2006 Dowdy ..... 340/984
7,077,784 B2 * 7/2006 Banta et al. ..... 477/107
7,237,639 B2 * 7/2007 Kowatari et al. ..... 180/243
7,308,352 B2 * 12/2007 Wang et al. ..... 701/70
7,549,243 B1 * 6/2009 Gilles ..... 37/468
7,596,446 B1 * 9/2009 Sakayanagi et al. ..... 701/105
7,800,359 B2 * 9/2010 Goto et al. ..... 324/207.25
2005/0062449 A1 * 3/2005 Wang et al. ..... 318/366
2005/0137060 A1 * 6/2005 Kuras et al. ..... 477/214
2006/0150809 A1 * 7/2006 Shah ..... 91/472
2007/0099757 A1 * 5/2007 Landes ..... 477/175
2009/0210125 A1 * 8/2009 Dessirier ..... 701/70
2009/0264252 A1 * 10/2009 Bertsch et al. ..... 477/121
2009/0326770 A1 * 12/2009 O'Neil et al. ..... 701/54
2010/0038158 A1 * 2/2010 Whitney et al. ..... 180/65.265
2012/0132490 A1 * 5/2012 Wang et al. ..... 188/159
2012/0242819 A1 * 9/2012 Schamp ..... 348/78

* cited by examiner

*Primary Examiner* — McDieunel Marc
(74) *Attorney, Agent, or Firm* — Jeff A. Greene

(57) ABSTRACT

A brake monitoring system for a machine has at least one traction motor coupled to drive wheels of the machine. An operator input device receives a requested retarding torque from an operator of the machine and sends a signal to a controller that is configured to compare the required retarding torque to a maximum retarding torque available at a particular speed of the traction motor. The controller selectively generates a warning signal based on a comparison of the required retarding torque to a maximum retarding torque available.

16 Claims, 5 Drawing Sheets

BRAKE MONITORING SYSTEM

TECHNICAL FIELD

The present disclosure relates to a machine and, in particular, to a brake monitoring system for the machine moving down an incline.

BACKGROUND

Heavy machinery, such as off-highway trucking equipment, is commonly used in mining, heavy construction, quarrying, and other applications. Due to the substantial capital investment involved, tight tolerances with respect to the time allotted for completing tasks and the expense of maintaining and operating heavy machinery, such as a mining truck, an entity can suffer significant monetary losses when the heavy machinery malfunctions. The complexity of modern heavy machinery often exacerbates this problem due to the need for skilled personnel to perform various tests on such machinery to trouble shoot such malfunctions. Even so, significant time is often spent locating the fault and then performing an appropriate repair.

One advance that has improved efficiency associated with the use of heavy machinery is the adoption of Alternating Current (AC) or electric drive systems. Electric drive systems typically require less maintenance and thus, have lower life cycle costs. However, when the heavy machinery malfunctions, the costs associated with determining the fault location and repair are often substantial. For example, while braking or decelerating of a heavy vehicle, the heavy vehicle may malfunction if the heavy vehicle exceeds a maximum retarding capacity available. This may in turn cause increase in operational and maintenance costs of the heavy vehicle.

The present disclosure is directed to overcome one or more of the problems as set forth above.

SUMMARY

In one aspect, the present disclosure provides for a system for monitoring braking of a machine. The system comprises a traction motor coupled to drive wheels of the machine. The system further comprises an operator input device to receive a requested retarding torque from an operator of the machine. The system may further comprise a controller configured to compare the required retarding torque to a maximum retarding torque available at a particular speed of the traction motor. The controller is also configured to selectively generate a warning signal based on a comparison of the required retarding torque to a maximum retarding torque available.

In another aspect, the present disclosure provides for a method for monitoring braking of a machine. The method comprises receiving a requested retarding torque from an operator of the machine. The method further comprises comparing the required retarding torque to a maximum retarding torque available at a particular speed of the traction motor and selectively generating a warning signal based on a comparison of the required retarding torque to a maximum retarding torque available.

In yet another aspect, the present disclosure provides for a machine comprising a power source, a traction motor operationally coupled to the power source, a retarding grid operationally coupled to the traction motor. The machine further comprises an operator input device to receive a requested retarding torque from an operator of the machine. The machine further comprises a controller configured to compare the required retarding torque to a maximum retarding torque available at a particular speed of the traction motor. The controller is also configured to selectively generate a warning signal based on a comparison of the required retarding torque to a maximum retarding torque available.

Other features and aspects of this disclosure will be apparent from the following description and the accompanying drawings.

DETAILED DESCRIPTION

Figure 1:
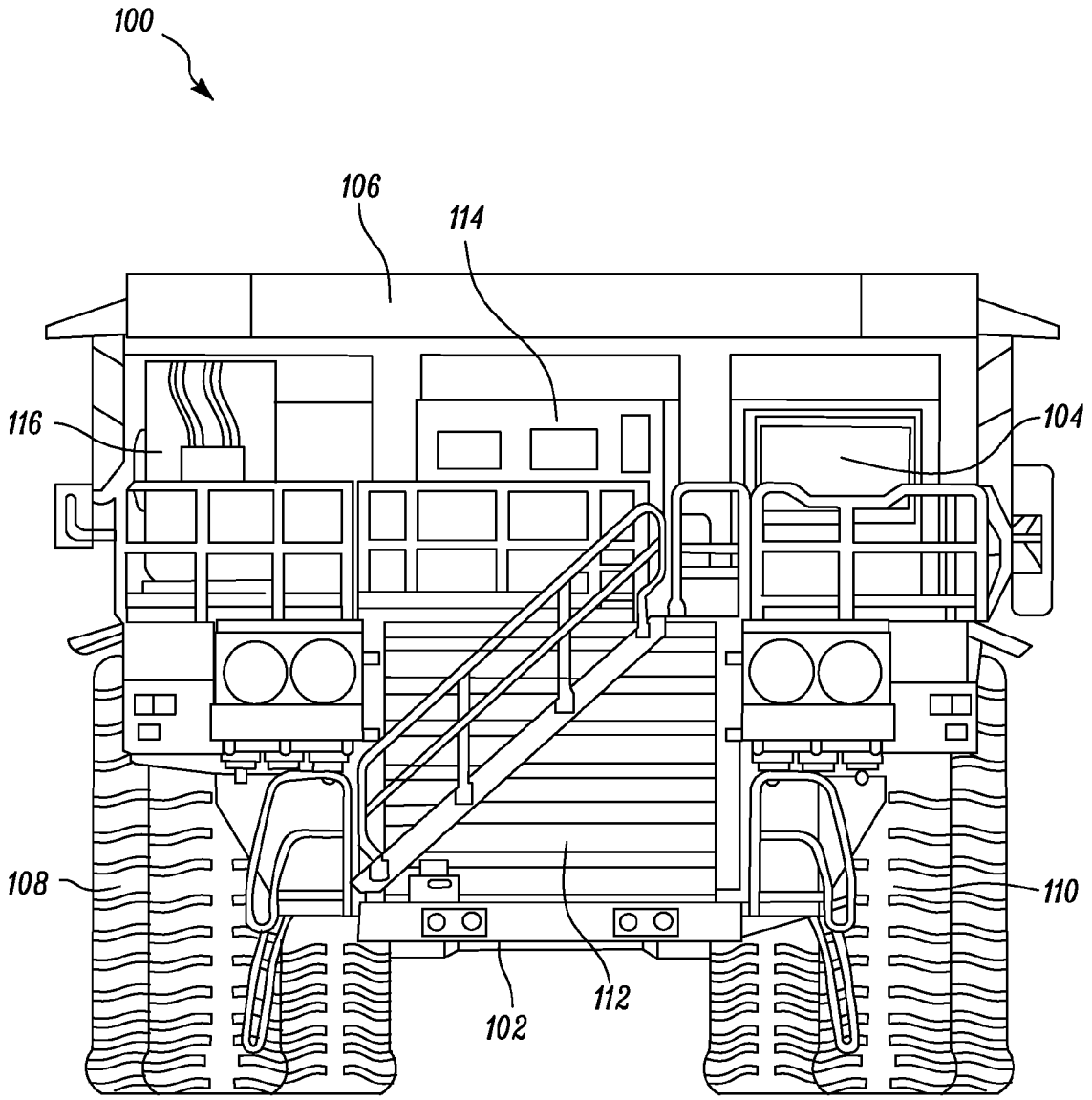
FIG. 1 is a front view of an exemplary machine implementing a brake monitoring system in accordance with an embodiment of the present disclosure.

Wherever possible, the same reference numbers will be used throughout the drawings to refer to the same or like parts. FIG. 1 represents an exemplary machine 100, according to one embodiment of the present disclosure. The machine 100, in an example, may be a direct series electric drive machine. One example of the machine 100 is an off-highway truck such as those used for construction, mining, or quarrying. In the description that follows, this example illustrates the various arrangements that can be used on machines having direct series electric drive systems. As can be appreciated, any other vehicle having a direct series electric drive or electric-only arrangement can benefit from the advantages described herein. The term "machine," therefore, is used to generically describe any machine having at least one drive wheel that is driven by a motor connected to the wheel. Electrical power may be generated onboard by a generator, alternator, or another power-generation device, each of which may be driven by an engine or other prime mover. Alternatively, electrical power may be stored but not generated onboard.

A front view of the machine 100 is shown in FIG. 1. The machine 100 includes a chassis 102 that supports an operator cab 104 and a bucket 106. The bucket 106 is pivotally connected to the chassis 102 and is arranged to carry a payload when the machine 100 is in service. An operator occupying the operator cab 104 can control the motion and the various functions of the machine 100. The chassis 102 supports various drive system components. These drive system components are capable of driving a set of drive wheels 108 to propel the machine 100. A set of idle wheels 110 can steer such that the machine 100 can move in any direction. Even though the machine 100 includes a rigid chassis with powered wheels for motion and steerable wheels for steering, one can appreciate that other machine configurations can be used. For example, such configurations may include articulated chassis with one or more driven wheels.

Figure 2:
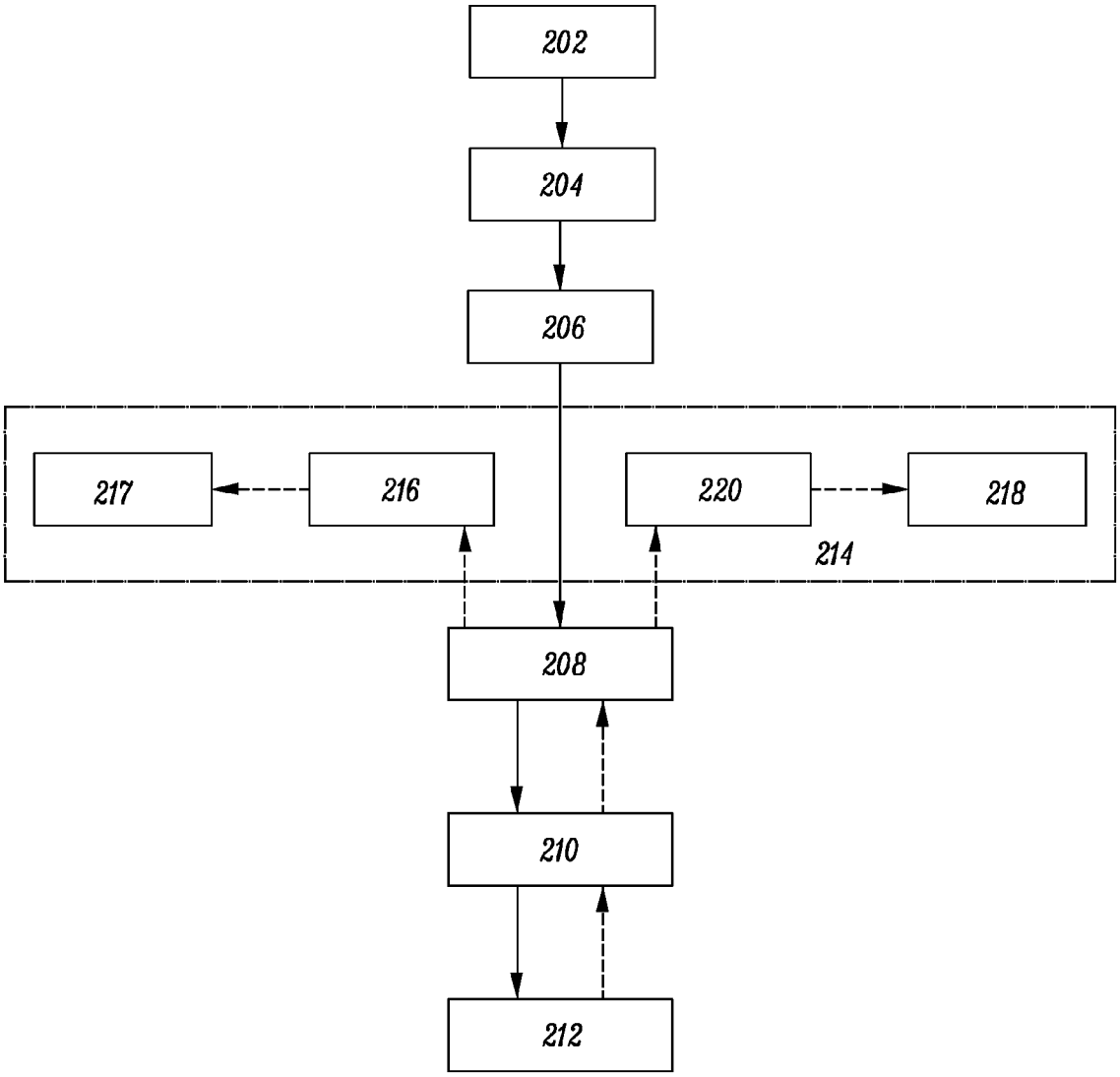
FIG. 2 is a block diagram of a direct series electric drive system for the machine in accordance with an embodiment of the present disclosure.

The machine 100 is a direct series electric drive machine to drive the drive wheels 108. A block diagram for the direct series electric drive system of the machine 100, for example, off-highway truck, is shown in FIG. 2. In the block diagram, the flow direction of power in the system when the machine 100 is propelled is denoted by solid-lined arrows. Conversely, the flow of power during a retarding mode is shown in dash-lined arrows. The direct series electric drive system includes an engine 202, for example, an internal combustion engine such as a diesel engine, which produces an output torque at an output shaft (not shown). The output shaft of the engine 202 is connected to a generator 204. The generator 204, in an example, may be a three-phase alternating current (AC) synchronous generator having a brushless, wound rotor.

In operation, the output shaft of the engine 202 rotates a rotor of the generator 204 to produce electrical power, for example, in the form of alternating current (AC) power. This electrical power is supplied to a rectifier 206 and converted to direct current (DC) power. The rectifier 206, in an example, may be a poly-phase diode bridge, and in particular is a three phase full bridge rectifier.

The rectified DC power may be converted again to an AC power by an inverter circuit 208. The inverter circuit 208 may be capable of selectively adjusting the frequency and/or pulse-width of its output, such that traction motors 210 that are connected to an output of the inverter circuit 208 may be operated at variable speeds. The traction motors 210 may be connected via final assemblies (not shown) or directly to drive wheels 212 of the machine 100.

When the machine 100 is propelled, the engine 202 generates mechanical power that is transformed into electrical power, which is conditioned by various electrical components. In an illustrated embodiment, such components are housed within the cabinet 114, as shown in FIG. 1. The cabinet 114 is disposed on a platform that is adjacent to the operator cab 104 and may include the rectifier 206, the inverter circuit 208, and/or other components. When the machine 100 is to be decelerated or its motion is otherwise to be retarded, for example, to prevent acceleration of the machine 100 when moving down an incline, its kinetic energy is converted to electrical energy. Effective disposition of this generated electrical power enables effective retarding of machine 100. Further, when the machine 100 is moving down an incline, a retarding torque is required to counter a downward force on the machine 100 due to gravity and thus, running the machine 100 on rated parameters, such as speed, as required by the operator of the machine 100.

Specifically, when the machine 100 is retarding, the kinetic energy of machine the 100 is transferred into rotational power of the drive wheels 212 that rotates the traction motors 210, which act as electrical generators. The electrical power generated by the traction motors 210 has an AC waveform. The inverter circuit 208 may include a bridge inverter, such that power supplied by the traction motors 210 is rectified into DC power. Dissipation of the DC power generated by the traction motors 210 produces a counter-rotational torque at the drive wheels 108 to decelerate the machine 100 or to provide a retarding torque to counter an effect of the gravity on the machine 100, while moving down an incline. Dissipation of this DC power may be accomplished by passing the generated current rectified by the inverter circuit 208 through a resistance. To accomplish this, a retarding grid 214 is provided to receive current from the inverter circuit 208 via a switch 216. When the switch 216 is closed, the electrical power corresponding to the current generated by the traction motors 210 may pass through a first resistor bank 217 and dissipate as heat. Additionally, excess electrical power is also dissipated as heat as it passes through a second resistor bank 218, which is arranged to receive electrical power via a chopper circuit 220. The chopper circuit 220 operates to selectively route a portion of the developed electrical power through the second resistor bank 218.

In alternative embodiments, the engine 202 and the generator 204 are not required to supply the power necessary to drive the traction motors 210. Instead, such alternative embodiments use another source of power, such as a battery or contact with an electrified rail or cable. In some embodiments, a single drive motor may be used to power all drive wheels of a machine, while in other embodiments, any number of drive motors may be used to power any number of drive wheels, including all wheels connected to the machine 100.

Figure 3:
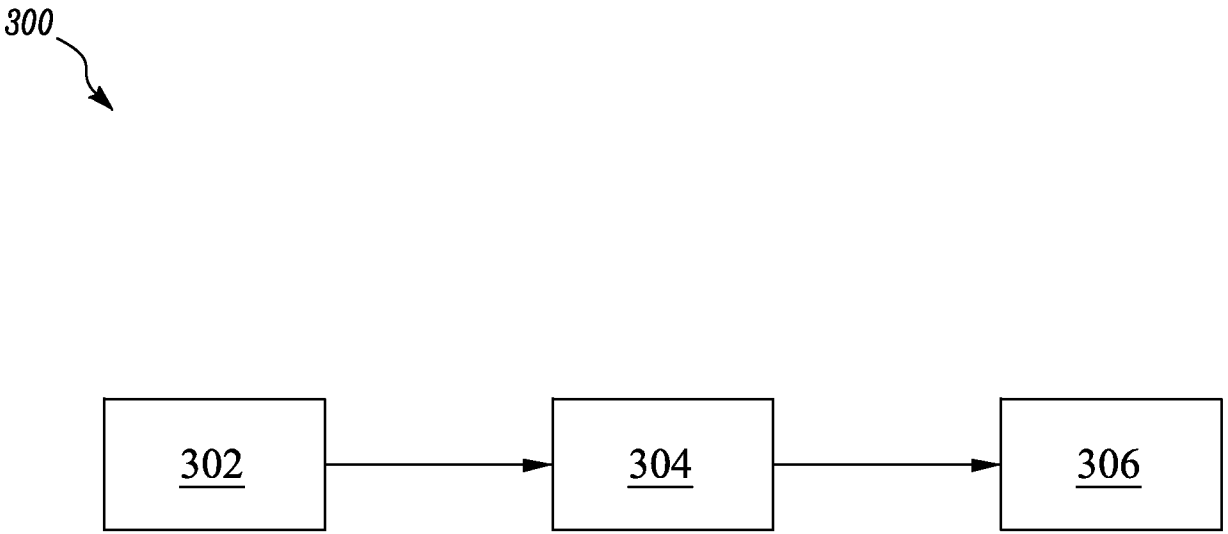
FIG. 3 is an exemplary block diagram of working of the brake monitoring system in accordance with an embodiment of the present disclosure.

FIG. 3 illustrates a block diagram depicting working of a brake monitoring system 300 of the machine 100. Brake monitoring system 300 monitors a requested retarding torque from the operator of the machine 100, while the machine 100 is moving down an incline. The operator of the machine 100, may want to operate the machine 100 within rated parameters such as speed, while moving down an incline, for example, in a mine site, to have optimized productive time cycle for the machine 100. The machine 100 experiences a downward force due to gravity while moving down the incline and thus experiences acceleration if a retarding torque is not applied to counter the effect of the gravity on the machine 100. The operator may request the required retarding torque to enable the machine 100 to move down the incline with a substantially constant speed. The operator may request the retarding torque through an operator input device 302 placed in the operator cab 104. In an embodiment, the machine 100 may be operated either on cruise control speed mode or a manual control speed mode. Thus, the operator input device 302 includes at least one of a cruise control speed device, retard pedal or a retard lever. It may be apparent to a person of ordinarily skilled in the art that the above examples of the operator input device 302 are exemplary and may not limit the scope of the present disclosure.

In an embodiment, during the cruise speed control mode, the operator may set a desired speed through the operator input device 302 (cruise speed control device) for the descent of the machine 100. In order to maintain the descent speed of the machine 100, a retarding torque is required to counter the effect of the gravity on the machine 100. The operator input device 302 is communicably coupled to a controller 304, and the controller 304 receives the requested retarding torque that may be calculated through a close loop circuit embodied in the cruise speed control device.

In another embodiment, during the manual speed control mode, the operator may utilize the operator input device 302 such as retard pedal or retard level to request a retarding torque to maintain a particular descent speed of the machine 100. As the controller 304 is communicably coupled with the operator input device 302, the controller 304 receives the requested retarding torque from the operator through the operator input device 302.

The controller 304 is further configured to compare the requested retarding torque with a maximum available retarding torque at a particular speed of the traction motor 210. Further, the controller 304 may selectively generate a warning signal to the operator based on the comparison of the requested retarding torque and the maximum available retarding torque.

The warning signal generated by the controller 304 may be an audible signal, a visible signal, an audio-video signal and/or a tactile signal. For example, the controller 304 may generate an audio warning signal that can be played through a speaker device (not shown) installed within the operator cab 104. In another example, the controller 304 may generate a visible warning signal to be displayed on a graphical user interface (GUI) 306. The visible warning signal may be a message displayed on GUI 306 stating that "required torque exceeds available torque".

Figure 4:
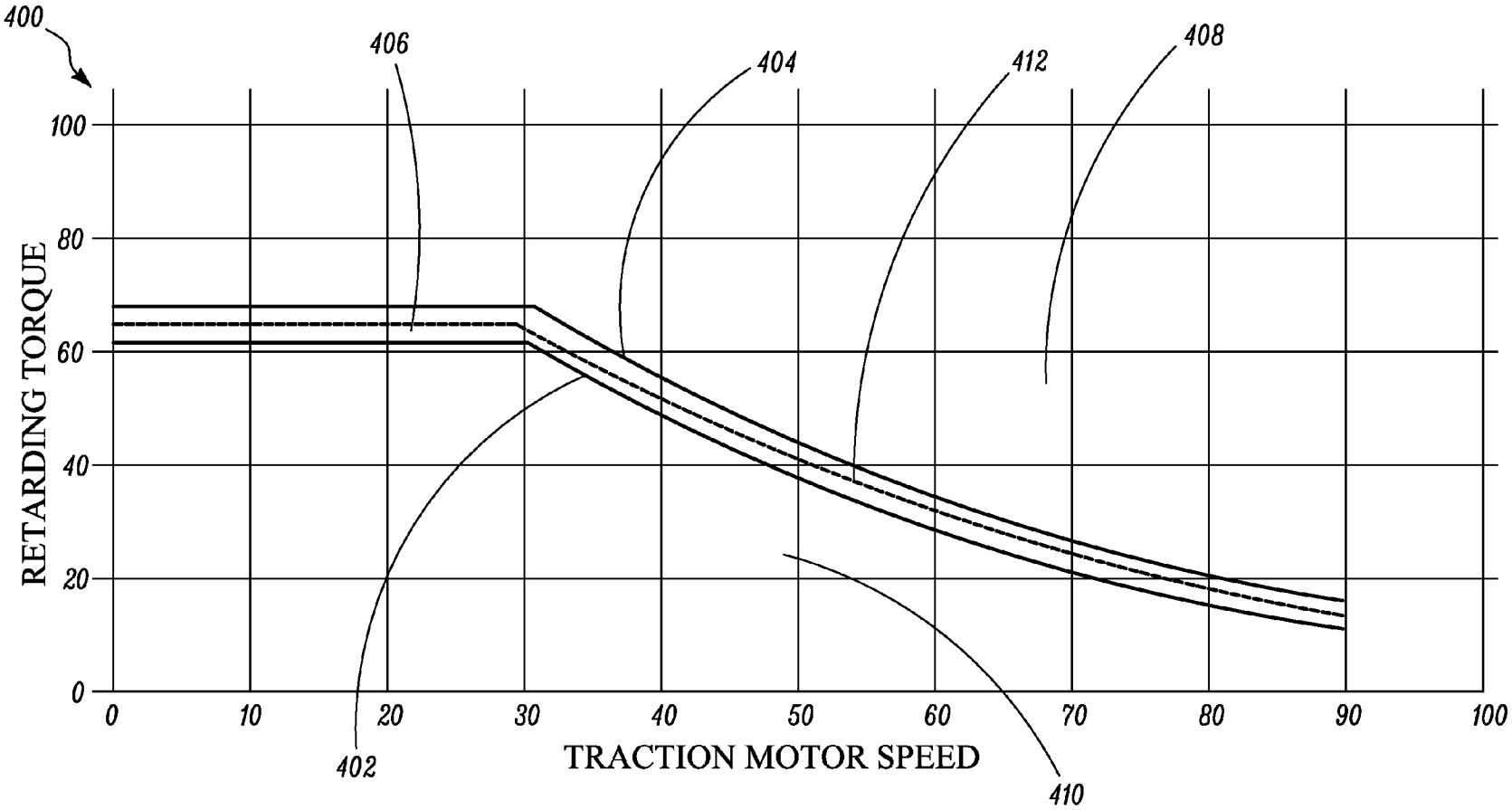
FIG. 4 illustrates a graphical representation of a retarding capacity of the machine, in accordance with embodiment of the present disclosure.

In an embodiment, the controller 304 generates the warning signal, when the requested retarding torque from the operator exceeds a maximum available retarding torque associated with a machine rated capacity of the machine 100 for more than a pre-defined period of time. FIG. 4 illustrates a graphical representation 400 of a retarding capacity of the machine 100, in accordance with embodiment of the present disclosure. The curve 402 represents an availability of the maximum retarding torque associated with the machine rated retarding capacity. The machine rated retarding capacity is generally the maximum retarded capacity of the machine 100 as may be indicated by a manufacturer at various speeds of the traction motors 210. Similarly, the curve 404 represents an availability of the maximum retarding torque associated with a drivetrain of the machine 100 at various speeds of the traction motors 210.

In an event, where the operator requested retarding torque exceeds the maximum available torque associated with the machine rated retarding capacity (represented by the curve 402), and less than the maximum available retarding torque available associated with the drive train of the machine 100 (represented by curve 404), then the controller 304 generates the warning signal after a pre-defined period of time, which may depend on several operational parameters of the machine 100. For example, if the requested retarding torque lies in a region 406 of the graph 400, then the controller 304 may generate the warning signal after the pre-defined period of time, such as 10 (ten) seconds.

In another embodiment, if the operator requested retarding torque approaches a first pre-defined percentage of the maximum available torque associated with the drive-train of the machine 100, then the controller 304 generates the warning signal instantaneously, may be in a short period of time such as 1 (one) second.

Also, the controller 304 may prioritize generating the warning signal, in an event where the pre-defined period for the machine rated retarding capacity may not be reached but the requested retarding torque is around the first pre-defined percentage of the maximum available retarding torque associated with the drive-train of the machine 100. In no event, the controller 304 may allow the requested retarding torque to be greater than the drive-train retarding torque, and generates instant warning signals for such requests. For example, the requested retarding torque may not fall in the region 408 in the graphical representation 400. In an ideal situation, the requested retarding torque should lie below the curve 402 and in the region 410 of the graphical representation 400.

In an embodiment, the maximum available retarding torque associated with the drive-train of the machine 100 scales based on a thermal de-rate of the retarding grid 214. The maximum available retarding torque associated with the drive-train of the machine 100 is inversely dependent on the thermal de-rate of the retarding grid 214.

Generally, to counter the effect of the gravity on the machine 100 moving down the incline, the traction motors 210 generates substantially large amount of AC electric power. The substantially large amount of AC electric power is converted to DC power by the inverter 208 and dissipated as heat from the first and the second resistor banks 217, 218 (as shown in FIG. 2). As the DC power is dissipated as heat through the retarding grid 214, one or more cooling fans (not shown) are installed within the retarding grid 214, for cooling the first and the second resistor banks 217, 218. The first and the second resistor banks 217, 218 may have a threshold heat dissipation limit above which heat dissipation capability of the first and the second resistor banks 217, 218 may be affected.

The one or more cooling fans may operate in a way such that the heat generated for dissipation does not exceed the threshold heat dissipation limit of the first and the second resistor banks 217, 218. However, in some cases the heat generated for dissipation may exceed the threshold heat dissipation limit of the first and the second resistor banks 217, 218. In such cases, in order to avoid failure of the retarding grid 214, DC power being sent to the retarding grid 214 is reduced. For reducing DC power sent to the retarding grid 214, AC electric power generated by the traction motors 210 is reduced, which eventually results in a lesser retarding torque available for the particular speed of the traction motors 210. A curve 412 represents a scaled down retarding torque available associated with the drive-train of the machine 100. This ensures that the heat generated and dissipated by the retarding grid 214 is limited below the threshold heat dissipation limit of the first and the second resistor banks 217, 218.

In an embodiment of the cruise speed control mode, in an event of the thermal de-rate of the retarding grid 214, the controller 304 compares if the requested retarding torque approaches the first pre-defined percentage of the scaled down (curve 412) maximum available retarding torque associated with the drive train of the machine 100. The exemplary first pre-defined percentage may include 99% (ninety nine percent) of the scaled down maximum available retarding torque associated with the drive-train of the machine 100.

In an embodiment of the manual speed control mode, in an event of the thermal de-rate of the retarding grid 214, the controller 304 compares if the requested retarding torque approaches the second pre-defined percentage of the scaled down (curve 412) maximum available retarding torque associated with the drive train of the machine 100. The second pre-defined percentage may include 101% (hundred and one percent) of the scaled down maximum available retarding torque associated with the drive-train of the machine 100. The controller 304 may instantaneously generates the warning signal if the requested retarding torque approaches the 101% of the curve 412, for example, the warning signal may be generated within 1 (one) second of receiving the requested retarding torque.

INDUSTRIAL APPLICABILITY

The machine 100 may be one of various types of machines, including transporting vehicles such as trucks, excavators, passenger vehicles, machine tools, industrial process controllers and the like. The brake monitoring system 300 monitors a requested retarding torque from the operator of the machine 100, while the machine 100 is moving down an incline. The operator of the machine 100, may want to operate the machine 100 within rated parameters such as speed, while moving down the incline, for example, in a mine site, to have optimized productive time cycle for the machine 100. The machine 100 experiences a downward force due to gravity while moving down the incline and thus experience acceleration if a retarding torque is not applied to counter the effect of the gravity on the machine 100. The operator may request the required retarding torque to enable the machine 100 to move down the incline with a substantially constant speed. The controller 304 is further configured to compare the requested retarding torque with a maximum available retarding torque at a particular speed of the traction motors 210. Further, the controller 304 may selectively generate a warning signal to the operator based on the comparison of the requested retarding torque and the maximum available retarding torque. The warning signal to the operator may enable the operator to take preventive steps before a failure of the drive-train of the machine 100 or from faulty operation. This system 300 may also reduce operational and/or maintenance costs. Operation of the disclosed the brake monitoring system 300 will now be described in detail with reference to FIG. 5.

Figure 5:
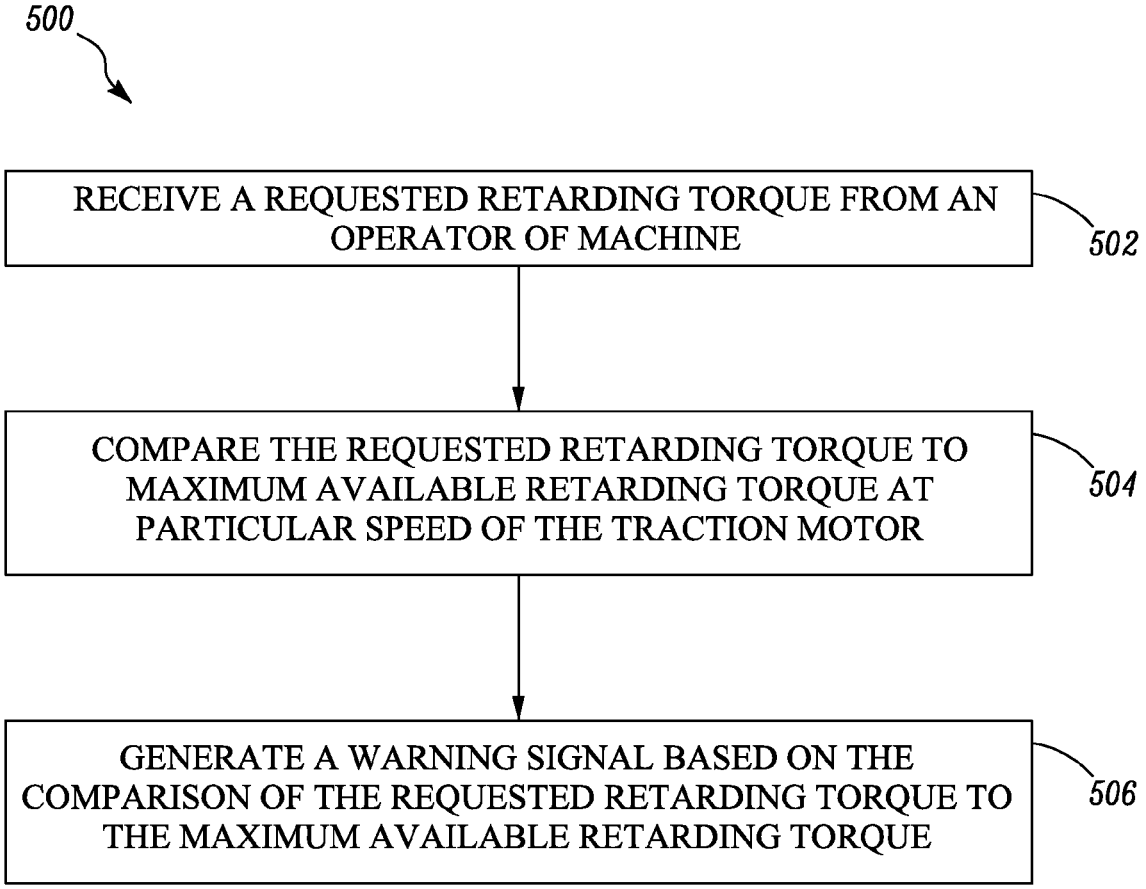
FIG. 5 is an exemplary process flow for monitoring braking of the machine, in accordance with an embodiment of the present disclosure.

FIG. 5 illustrates a process flow 500 for monitoring retarding capacity of the machine 100. At step 502, the system 300 receives a requested retarding torque from the operator of the machine 100. In an embodiment, the retarding torque may be requested through the operator input device 302 such as the cruise speed control device, retard pedal, or retard lever depending on mode of the operation of the machine 100.

At step 504, the system 300 compares the requested retarding torque with the maximum available retarding torque at the particular speed of the traction motors 210. Further, at step 506, the system 300 may selectively generate a warning signal to the operator based on the comparison of the requested retarding torque and the maximum available retarding torque. The warning signal generated by the system 300 may be an audible signal, a visible signal, an audio-video signal and/or a tactile signal.

In an embodiment, the system 300 generates the warning signal, when the requested retarding torque from the operator exceeds a maximum available retarding torque associated with a machine rated capacity of the machine 100 for more than a pre-defined period of time.

In an event, where the operator requested retarding torque exceeds the maximum available torque associated with the machine rated retarding capacity, and less than the maximum available retarding torque available associated with the drive train of the machine 100, then the system 300 generates the warning signal after a pre-defined period of time, which may depend on several operational parameters of the machine.

In another embodiment, if the operator requested retarding torque approaches a first pre-defined percentage of the maximum available torque associated with the drive-train of the machine 100, then the system 300 generates the warning signal instantaneously.

In an embodiment, the maximum available retarding torque associated with the drive-train of the machine 100 scales based on a thermal de-rate of the retarding grid 214.

In an embodiment of the cruise speed control mode, in an event of the thermal de-rate of the retarding grid 214, the system 300 compares if the requested retarding torque approaches the first pre-defined percentage of the scaled down maximum available retarding torque associated with the drive train of the machine 100.

In an embodiment of the manual speed control mode, in an event of the thermal de-rate of the retarding grid 214, the system 300 compares if the requested retarding torque approaches the second pre-defined percentage of the scaled down maximum available retarding torque associated with the drive train of the machine 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A system for monitoring braking of a machine, the system comprising:

a traction motor connected to drive wheels of the machine;

an operator input device configured to receive a requested retarding torque from an operator of the machine;

a controller communicably coupled to the operator input device, the controller configured to:

compare the requested retarding torque to a maximum available retarding torque at a particular speed of the traction motor; and selectively generate a warning signal based on the comparison of the requested retarding torque to the maximum available retarding torque, if the requested retarding torque exceeds the maximum available retarding torque, associated with a machine rated retarding capacity, for more than a pre-defined period of time.

2. The system of claim 1, wherein the operator input device includes at least one of a cruise speed control device, retard pedal and a retard lever.

3. The system of claim 1, wherein the machine is operated in at least one of a cruise speed control mode and a manual speed control mode.

4. The system of claim 1, wherein the controller is configured to generate the warning signal if the requested retarding torque approaches a first pre-defined percentage of the maximum available retarding torque, associated with a drive-train retarding capacity of the machine.

5. The system of claim 4, wherein the maximum available retarding torque associated with the drive-train of the machine scales based on a thermal de-rate of a retarding grid.

6. The system of claim 5, wherein the maximum available retarding torque has an inverse dependency on the thermal de-rate of the retarding grid.

7. The system of claim 5, wherein the controller is configured to generate the warning signal, during a manual speed control mode of the machine, if the requested retarding torque approaches a second pre-defined percentage of the maximum available retarding torque, associated with a drive-train retarding capacity of the machine in an event of the thermal de-rate of the retarding grid.

8. The system of claim 1, wherein the warning signal is one of an audible warning signal, a visible warning signal, an audio-visual warning signal and a tactile warning signal.

9. A method for monitoring braking of a machine, the method comprising:

receiving a requested retarding torque from an operator of the machine;

comparing by a controller the requested retarding torque to a maximum available retarding torque at a particular speed of a traction motor; and generating a warning signal based on the comparison of the requested retarding torque to the maximum available retarding torque, if the requested retarding torque exceeds the maximum available retarding torque, associated with a machine rated retarding capacity, for more than a pre-defined period of time.

10. The method of claim 9, wherein the operator input device includes at least one of a cruise speed control interface, retard pedal and a retard lever.

11. The method of claim 9 further comprises operating the machine in at least one of a cruise speed control mode and a manual speed control mode.

12. The method of claim 9 further comprises generating the warning signal if the requested retarding torque approaches a first pre-defined percentage of a maximum available retarding torque, associated with a drive-train retarding capacity of the machine.

13. The method of claim 9 further comprises scaling the maximum available retarding torque associated with the drive-train of the machine scales based on a thermal de-rate of a retarding grid.

14. The method of claim 9 further comprises generating the warning signal, during a manual speed control mode of the machine, if the requested retarding torque approaches a second pre-defined percentage of the maximum available retarding torque, associated with a drive-train retarding capacity of the machine in an event of the thermal de-rate of the retarding grid.

15. The method of claim 9, wherein the warning signal is one of an audible warning signal, a visible warning signal, an audio-visual warning signal and a tactile warning signal.

16. A machine comprising:

a power source;

a traction motor operationally coupled to the power source;

a retarding grid operationally coupled to the traction motor;

an operator input device configured to receive a requested retarding torque from an operator of the machine;

a controller communicably coupled to the operator input device, the controller configured to:

compare the requested retarding torque to a maximum available retarding torque at a particular speed of the traction motor; and selectively generate a warning signal based on the comparison of the requested retarding torque to the maximum available retarding torque, if the requested retarding torque exceeds the maximum available retarding torque, associated with a machine rated retarding capacity, for more than a pre-defined period of time.

* * * * *